US010098399B2

(12) United States Patent
Smith

(10) Patent No.: US 10,098,399 B2
(45) Date of Patent: Oct. 16, 2018

(54) DISPOSABLE VISOR

(71) Applicant: Kelly Bryant Smith, Raleigh, NC (US)

(72) Inventor: Kelly Bryant Smith, Raleigh, NC (US)

( * ) Notice: Subject to any disclaimer, the term of this patent is extended or adjusted under 35 U.S.C. 154(b) by 424 days.

(21) Appl. No.: 14/730,406

(22) Filed: Jun. 4, 2015

(65) Prior Publication Data

US 2016/0353824 A1 Dec. 8, 2016

(51) Int. Cl.

| | |
|---|---|
| ***A42B 1/22*** | (2006.01) |
| ***A42B 1/06*** | (2006.01) |
| ***A42B 1/20*** | (2006.01) |

(52) U.S. Cl.

CPC ..... *A42B 1/22* (2013.01); *A42B 1/062* (2013.01); *A42B 1/208* (2013.01)

(58) Field of Classification Search

CPC .... A42B 1/18; A42B 1/22; A42B 1/02; A42B 1/04; A42B 1/00

USPC ..... 2/171, 181, 182.8, 183, 209.11, 200.1, 2/200.3, 209.7

See application file for complete search history.

(56) References Cited

U.S. PATENT DOCUMENTS

| | | | | |
|---|---|---|---|---|
| 1,250,968 | A * | 12/1917 | Claussen | A42B 1/248 2/195.1 |
| 3,266,056 | A | 8/1966 | De Villers et al. | |
| 4,670,910 | A | 6/1987 | Rosasco | |
| 4,771,477 | A * | 9/1988 | Cahill | A42B 1/208 2/12 |
| 4,912,779 | A | 4/1990 | Laird | |
| 2014/0057074 | A1 | 2/2014 | McInturff | |

* cited by examiner

*Primary Examiner* — Clinton T Ostrup
*Assistant Examiner* — Heather Mangine
(74) *Attorney, Agent, or Firm* — Coats & Bennett, PLLC

(57) ABSTRACT

A disposable visor to be worn on a user's head comprises a substantially flat body made of a flexible sheet material. The flat body includes a bill section that projects forwardly from the user's head when the visor is worn by the user to shield the user's face from the sun and a head-band section that connects to the bill section and forms a continuous uninterrupted band that encircles the user's head. A head opening is formed in the flat body and is configured to receive the user's head. A plurality of flexible fingers surrounds the head opening and are adapted to engage the user's head when the visor is worn by the user. During use, the fingers bend upwardly when the visor is placed on the user's head to adjust the head opening to the size of the user's head.

4 Claims, 2 Drawing Sheets

DISPOSABLE VISOR

BACKGROUND

The present invention relates generally to sun protection devices and, more particularly, to a disposable visor that is made from a single piece of sheet material, such as paper, cardboard, or plastic.

Skin rejuvenation procedures include laser resurfacing, micro needling and chemical peels. These procedures damage the surface of the skin and often result in small amounts of blood or fluids to be present on the skin temporarily. These procedures are commonly applied to the face.

The patient must be careful to avoid direct sun exposure immediately following the skin rejuvenation procedure in an effort to minimize the chance of post inflammatory hyperpigmentation. The patient must also take precautions to avoid touching the skin with a potentially contaminated item such as a personal hat or visor containing sweat, make-up or bacteria

SUMMARY

The present disclosure relates to a disposable visor that is made from a single sheet of material, such as paper, cardboard, or plastic. The visor includes a substantially flat body including a head opening to receive the user's head, a bill section, and a headband section. The bill section extends forwardly to shield the user's face from the sun when worn by the user. The headband section connects to the bill section and encircles the user's head. The headband section likewise extends outwardly from the user's head and over the user's ears to provide protection from the sun. A plurality of circumferential spaced fingers surround the head opening. When the visor is worn by the user, the fingers bend upwardly to adjust the size of the head opening to the user's head providing a more comfortable fit. The disposable visor allows the patient to shade the face and ears from direct sun exposure and can be placed on the head to avoid touching the treated skin.

DETAILED DESCRIPTION

Figure 1:
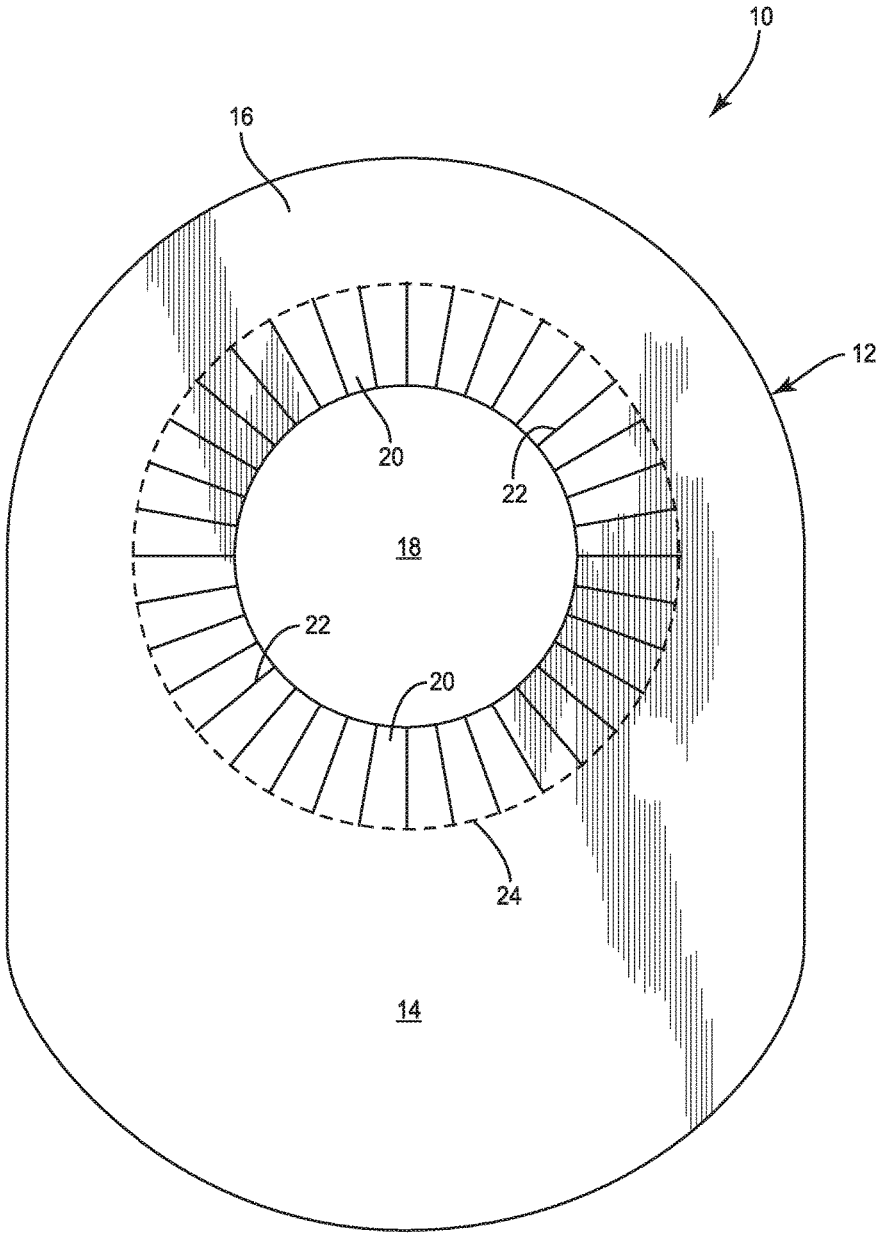
FIG. 1 is a top plan view of a disposable visor according to one embodiment of the disclosure.

Referring now to the drawings, FIG. 1 illustrates a disposable visor according to one embodiment. The disposable visor is indicated generally by the numeral 10. The disposable visor 10 can be made from a single piece of sheet material, such as paper, cardboard or plastic. The disposable visor 10 includes a generally oval shaped body 12 having a head opening 18 therein to receive the user's head. The body 12 includes a bill section 14 and a headband section 16. The bill section 14 generally comprises the area of the body 12 in front of the head opening 18. The headband section 16 connects to the bill section 14 and forms a continuous, unbroken band that encircles the user's head. That is, the headband section 16 does not have free ends that need to be joined to secure the disposable visor 10 on the user's head or to adjust the size of the disposable visor.

The head opening 18 is surrounded by a plurality of flexible fingers 20 separated by radially extending slits 22 in the main body 12. In one embodiment, the main body 12 is approximately 11½" wide and 15¾" long. The center of the head opening 18 is approximately 5¾" from the rearmost point of the body 12 and s approximately 5" in diameter. The flexible fingers are approximately 1½" in length. Depending on the strength of the material, the length of the fingers may be anywhere between 20% and 40% of the diameter of the head opening 18 so as to provide for adjustment to various head sizes.

In one embodiment, the body 12 is made from solid bleached sulfate (SBS) paperboard. SBS is a premium grade paperboard produced from bleached virgin fiber with a relatively low stiffness ratio to allow bending of the bill section when the disposable visor is worn by the user.

Figure 2:
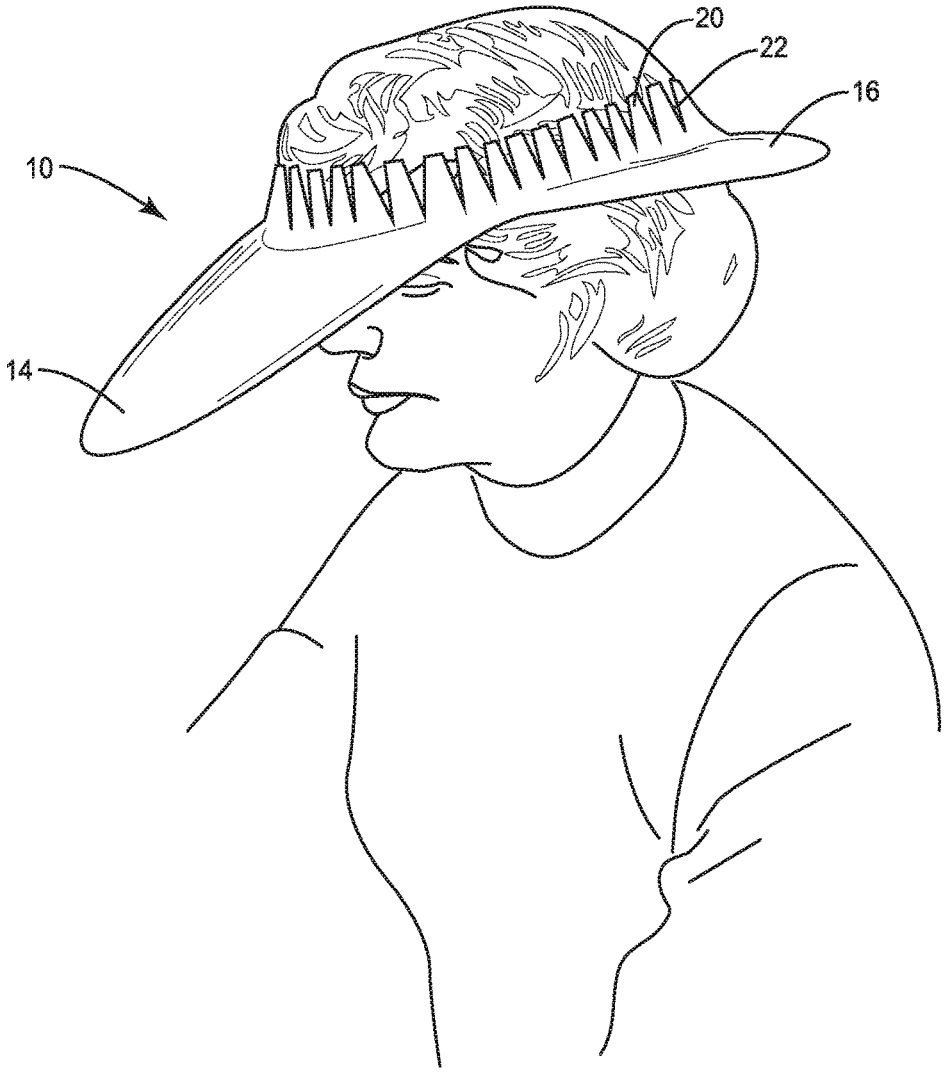
FIG. 2 is a perspective view of a woman wearing the disposable visor.

FIG. 2 illustrates the disposable visor 10 being worn on a user's head. As shown in FIG. 2, the user's head is inserted into the head opening 18 of the disposable visor 10. As the disposable visor 10 is pulled down on the user's head, the flexible fingers 20 bend upwardly to adjust to the size of the user's head. Thus, the flexible fingers 20 allow adjustment to various head sizes so that one size fits all without touching the treated area. When worn by the user, the bill section 14 projects forwardly from the user's head to shield the user's face from the sun. Similarly, in contrast to prior art visors having a headband section that lies flat against the user's head, the headband section 16 of the disposable visor 10 extends outwardly from the back and sides of the user's head. The side portions of the headband section 16 extend over the user's ears to shield the user's ears from the sun. Thus, the bill section 14 and headband section 16 form a continuous brim that extends entirely around the user's head.

From the forgoing description, it is apparent that the disposable visor 10 as herein described allows the patient to shade the face and ears from direct sun exposure and can be placed on the head to avoid touching the treated skin. The disposable visor 10 is also simple in construction, inexpensive to manufacture, and easy to use.

What is claimed is:

1. A disposable visor to be worn on a user's head comprising:

a substantially flat body made of a flexible sheet material including a bill section that projects forwardly from the user's head when the visor is worn by the user to shield the user's face from the sun and a headband section that connects to the bill section and forms a continuous uninterrupted band that encircles the user's head;

a head opening formed in the flat body configured to receive the user's head, a plurality of flexible fingers surrounding the head opening to engage the user's head when the visor is worn by the user, wherein a length of the flexible fingers is approximately 0.2 to 0.4 times a diameter of the head opening, and wherein the fingers are configured to normally lie in a plane of the flat body and to bend upwardly when the visor is placed on the user's head to adjust to the size of the user's head.

2. The disposable visor of claim 1 including 30 to 40 flexible fingers equally spaced around an entire circumference of the head opening.

3. The disposable visor of claim 1 wherein the headband section is configured to extend outwardly from the user's head when worn by the user.

4. The disposable visor of claim 3 wherein the headband section includes portions configured to extend outwardly from the user's head and over the user's ears to shield the user's ears from the sun.

* * * * *